US008398200B2

(12) United States Patent
Higuchi

(10) Patent No.: US 8,398,200 B2
(45) Date of Patent: Mar. 19, 2013

(54) RECORDING APPARATUS

(75) Inventor: Koji Higuchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/228,114

(22) Filed: Sep. 8, 2011

(65) Prior Publication Data

US 2012/0069076 A1 Mar. 22, 2012

(30) Foreign Application Priority Data

Sep. 17, 2010 (JP) ..... 2010-209083

(51) Int. Cl.
*B41J 29/38* (2006.01)

(52) U.S. Cl. ..... 347/16

(58) Field of Classification Search ..... 347/16, 347/101, 104
See application file for complete search history.

(56) References Cited

U.S. PATENT DOCUMENTS 7,441,857 B2 * 10/2008 Murase ..... 347/16

FOREIGN PATENT DOCUMENTS

| | | |
|---|---|---|
| JP | 2001-347691 | 12/2001 |
| JP | 2003-211749 | 7/2003 |
| JP | 2006-027812 | 2/2006 |

* cited by examiner

*Primary Examiner* — An Do
(74) *Attorney, Agent, or Firm* — Workman Nydegger

(57) ABSTRACT

A recording apparatus includes a supporting member on which a plurality of suction holes for sucking a recording medium are formed on a supporting face for supporting the recording medium, a transportation device which transports the recording medium along the supporting face, a recording head which ejects fluid on the recording medium supported by the supporting face so as to perform printing, and a control device which makes the recording head execute the printing when a front end of the recording medium in the transportation direction reaches to a position at which the front end of the recording medium covers the suction holes formed at downstream-most positions in the transportation direction on the supporting face.

8 Claims, 8 Drawing Sheets

RECORDING APPARATUS

The entire disclosure of Japanese Patent Application No: 2010-209083, filed Sep. 17, 2010 is expressly incorporated by reference herein.

BACKGROUND

1. Technical Field

The present invention relates to a recording apparatus.

2. Related Art

An ink jet printer has been disclosed as a recording apparatus in JP-A-2003-211749.

The ink jet printer uses a roll paper as a recording medium and includes a plurality of suction holes on a platen in order to keep planarity of the roll paper on a printing region printed by an ink jet head. The plurality of suction holes are gradually made smaller as the suction holes are away from the upstream side to the downstream side in a transportation direction of the recording medium. Further, the plurality of suction holes are gradually made smaller as the suction holes are away from the vicinity of a center position in a width direction of the recording medium to outer sides in the width direction.

With this configuration, as the recording medium is transported, the plurality of suction holes are closed sequentially from larger suction holes. Therefore, increase in a suction pressure can be accelerated. That is to say, even if small suction holes are not closed and are opened, a suction pressure enough to ensure planarity of the recording medium can be ensured because the small suction holes have a large flow path resistance.

However, the above ink jet printer is configured to perform printing on the recording medium in a state where the suction holes arranged at the downstream side with respect to a printing region of the ink jet head are opened. With this configuration, ink ejected from the ink jet head is attracted to the suction holes during flying and a so-called curved flying of ink is caused. Therefore, even if the planarity of the recording medium is ensured, printing quality is deteriorated in some case.

SUMMARY

An advantage of some aspects of the invention is to provide a recording apparatus which can suppress printing quality from being deteriorated while ensuring planarity of a recording medium.

A recording apparatus according to an aspect of the invention, it is preferable that the recording apparatus include a supporting member on which a plurality of suction holes for sucking a recording medium are formed on a supporting face for supporting the recording medium, a transportation device which transports the recording medium along the supporting face, a recording head which ejects fluid on the recording medium supported by the supporting face so as to perform printing, and a control device which makes the recording head execute the printing when a front end of the recording medium in the transportation direction reaches to a position at which the front end of the recording medium covers the suction holes formed at downstream-most positions in the transportation direction on the supporting face.

With this configuration, according to the aspect of the invention, the recording medium is transported along the supporting face of the platen and printing by the recording head is executed when the front end of the recording medium in the transportation direction reaches to a position at which the front end of the recording medium covers the suction holes formed at the downstream-most positions in the transportation direction on the supporting face. With this, all of the suction holes are closed and unnecessary air flow is not generated around the recording medium. Therefore, deterioration in printing quality due to curved flying of fluid can be suppressed.

Further, according to the aspect of the invention, it is preferable that a suction region on which the recording medium is sucked with the plurality of suction holes include a printing region printed by the recording head and extends to the upstream side and the downstream side with respect to the printing region in the transportation direction, and a length of the suction region at the downstream side be smaller than a length of the suction region at the upstream side in the transportation direction.

With this configuration, according to the aspect of the invention, the suction region at the downstream side with respect to the printing region in the transportation direction is made relatively smaller than the suction region at the upstream side with respect to the printing region in the transportation direction. Therefore, a region of the recording medium which gets out of the printing region to the downstream side in the transportation direction can be made smaller. Accordingly, a region of the recording medium on which printing is performed can be ensured to be large.

Further, according to the aspect of the invention, it is preferable that the plurality of suction holes form a plurality of rows along the transportation direction with spaces in a width direction of the recording medium, which is perpendicular to the transportation direction, and the plurality of suction holes having the same shape be arranged at a constant pitch on each row along the transportation direction.

With this configuration, according to the aspect of the invention, the suction holes having the same shape are formed at a constant pitch on each row along the transportation direction. Therefore, a suction force acted as the recording medium is transported can be made constant and variation thereof can be suppressed. Therefore, transportation accuracy of the recording medium can be enhanced.

Further, according to the aspect of the invention, it is preferable that the plurality of rows include first rows having the suction holes with a first shape and second rows having the suction holes with a second shape which is different from the first shape.

With this configuration, according to the aspect of the invention, the recording medium is sucked on the plurality of rows including the first rows having the suction holes with the first shape and the second rows having the suction holes with the second shape.

Further, according to the aspect of the invention, it is preferable that the second shape be an oblong hole shape extending in the transportation direction.

With this configuration, according to the aspect of the invention, shapes of the suction holes on the second rows are set to oblong hole shapes extending in the transportation direction of the recording medium. This enables the recording medium to be sucked even on a narrow region on which a sufficient width cannot be obtained.

According to the aspect of the invention, it is preferable that a plurality of fluid reception portions which are opened on the supporting face and receive the fluid be provided on the supporting face, and the fluid reception portions be provided at both sides of the second rows in the width direction.

With this configuration, according to the aspect of the invention, the suction holes on the second rows are arranged on a narrow region on which a sufficient width cannot be obtained because the ink reception portions are provided so that the recording medium is sucked.

Further, according to the aspect of the invention, it is preferable that a suction region on which the recording medium is sucked with the plurality of suction holes extend in a width direction of the recording medium, which is perpendicular to the transportation direction, and a suction stopping device which stops the suction with the suction holes which are out of the recording medium on the suction region in the width direction be provided.

With this configuration, according to the aspect of the invention, the suction region is made to extend in the width direction so as to correspond to a plurality of sizes of the recording medium. Further, suction with the suction holes which are out of the recording medium is stopped so as not to form unnecessary air flow around the recording medium.

Further, according to the aspect of the invention, it is preferable that the recording medium be unrolled and extended from a roll body and be transported.

With this configuration, according to the aspect of the invention, curls of the recording medium which is unrolled and extended from the roll body and is transported is corrected by the plurality of suction holes so that planarity of the recording medium can be enhanced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
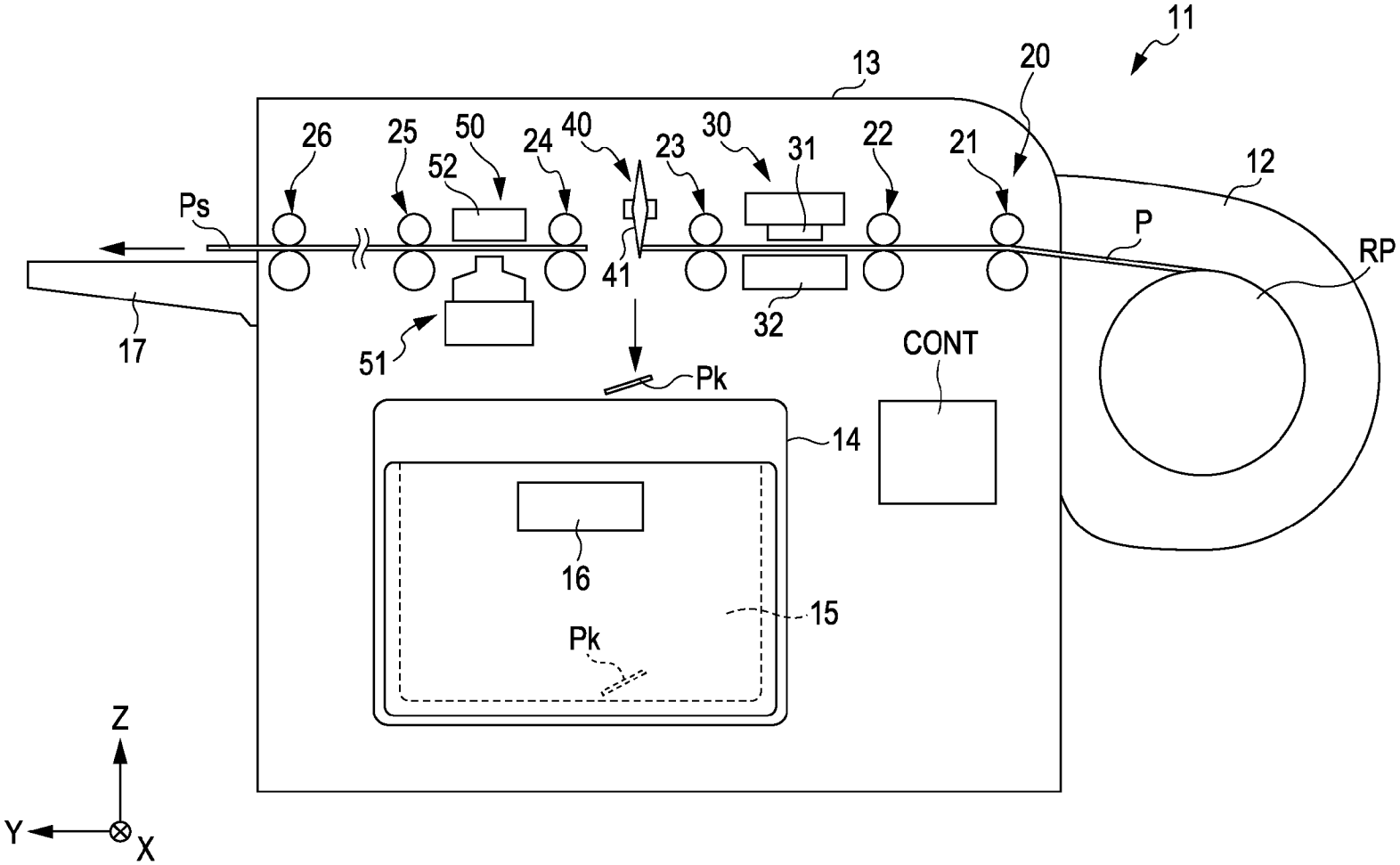
FIG. 1 is a schematic configuration view illustrating a printer according to an embodiment of the invention.

Hereinafter, an embodiment of a recording apparatus according to the invention is described with reference to drawings. It is to be noted that in the drawings used in the following description, an XYZ orthogonal coordinate system is set and a positional relationship of each member is described with reference to the XYZ orthogonal coordinate system in some case. Note that a predetermined direction in a horizontal plane is assumed to an X-axis direction (width direction), a direction perpendicular to the X-axis direction in the horizontal plane is assumed to a Y-axis direction (transportation direction), and a direction (vertical direction) perpendicular to the X-axis direction and the Y-axis direction is assumed to a Z-axis direction.

In the embodiment, an ink jet printer (hereinafter, simply referred to as "printer") as a recording apparatus is described as an example.

FIG. 1 is a schematic configuration view illustrating a printer 11 according to an embodiment of the invention.

The printer 11 ejects ink (fluid) from a recording head 31 onto a long paper (recording medium) P unrolled and extended from a roll paper (roll body) RP wound in a roll form so as to print images, characters or the like. The printer 11 includes a transportation portion (transportation device) 20, a recording portion 30, a cutting portion 40, a back printing portion 50, and a control device CONT. The transportation portion 20 transports a paper P unrolled and extended from the roll paper RP. The recording portion 30 performs printing onto the paper P. The cutting portion 40 cuts the paper P on which printing has been performed into a predetermined size. The back printing portion 50 performs printing on a back face of a paper Ps after cut. The control device CONT controls operations of the above constituent parts comprehensively.

The printer 11 includes a case 12 and a main body case 13. The roll paper RP is accommodated in the case 12. The transportation portion 20, the recording portion 30, the cutting portion 40, the back printing portion 50, and the like are accommodated in the main body case 13. Further, a paper discharge tray 17 is provided at the front side (+Y side) of the main body case 13. The paper Ps on which printing has been performed and which has been cut is discharged onto the paper discharge tray 17. Further, a container (hereinafter, referred to as "scrap container") 15 which receives and accumulates cut pieces Pk generated by cutting the paper P is arranged in a concave portion 14. The concave portion 14 is formed on a right side face of the main body case 13 and a face thereof is slightly concaved from a surface of the main body case 13. The scrap container 15 can be pulled out from the main body case 13 in the direction (X-axis direction) perpendicular to the transportation direction (Y-axis direction) in the embodiment. An end face of the scrap container 15 in the perpendicular direction is exposed on the concave portion 14. Further, a handle 16 for pulling out the scrap container 15 is provided on the end face thereof.

Hereinafter, constituent parts provided on the printer 11 are described in accordance with the transportation order of the paper P which is transported by a plurality of roller pairs functioning as the transportation portion 20 included in the printer 11. The transportation portion 20 has a paper feeding roller pair 21, transportation roller pairs 22, 23, 24, 25, and a paper discharge roller pair 26. At first, the paper P unrolled from the roll paper RP is fed to the recording portion 30 by the feeding roller pair 21. The recording portion 30 has a recording head 31 which ejects ink and a supporting table 32 which supports the paper P.

On the recording portion 30, the paper P fed from the roll paper RP is transported and an image or the like is printed on an upper face (surface) of the paper P. At first, the paper P is fed to between the recording head 31 and the supporting table 32 by the transportation roller pair 22. The fed paper P is transported while keeping a predetermined distance between an upper face (surface) of the fed paper P and the recording head 31. At this time, ink is ejected from the recording head 31 onto the upper face of the paper P so that printing is performed. Thereafter, the paper P is transported to the cutting portion 40 by the transportation roller pair 23.

The cutting portion 40 has a cutter 41 constituted by a rotary blade and the like as a functional part and cuts the paper P for each recording region corresponding to the printed image. At this time, on the cutting portion 40, the paper P is cut so as to remove unnecessary regions present at ends of the printed region in the transportation direction. Therefore, as illustrated in FIG. 1, when the paper P is cut, a cut piece Pk is generated and the generated cut piece Pk falls in the gravity direction. Accordingly, the scrap container 15 is arranged at the lower side with respect to the cutting portion 40 in order to receive and accumulate the falling cut piece Pk.

Subsequently, a paper Ps after cut is transported to the back printing portion 50 on which characters are printed on a back face. The back printing portion 50 has a printing unit 51 and a supporting table 52. The printing unit 51 is a so-called impact dot system printing unit which forms ink dots by pressing an ink ribbon against the lower face (back face) of the paper Ps. The supporting table 52 supports the paper Ps from the upper side at the time of the printing. On the back printing portion 50, the transported paper Ps is fed to between the printing unit 51 and the supporting table 52 by the transportation roller pair 24, at first. Dots are recorded on the lower face (back face) of the fed paper Ps by the printing unit 51 so that predetermined characters are printed thereon. Then, the fed paper Ps is fed in the transportation direction by the transportation roller pair 25.

Thereafter, the paper Ps is transported to a dryer (not illustrated), for example, and experiences processings such as drying by a heater unit (not illustrated) or the like as a functional part. Finally, the paper Ps is discharged onto the paper discharge tray 17 by the transportation roller pair 26.

Next, a configuration of the recording portion 30 in the embodiment is described in detail.

Figure 2:
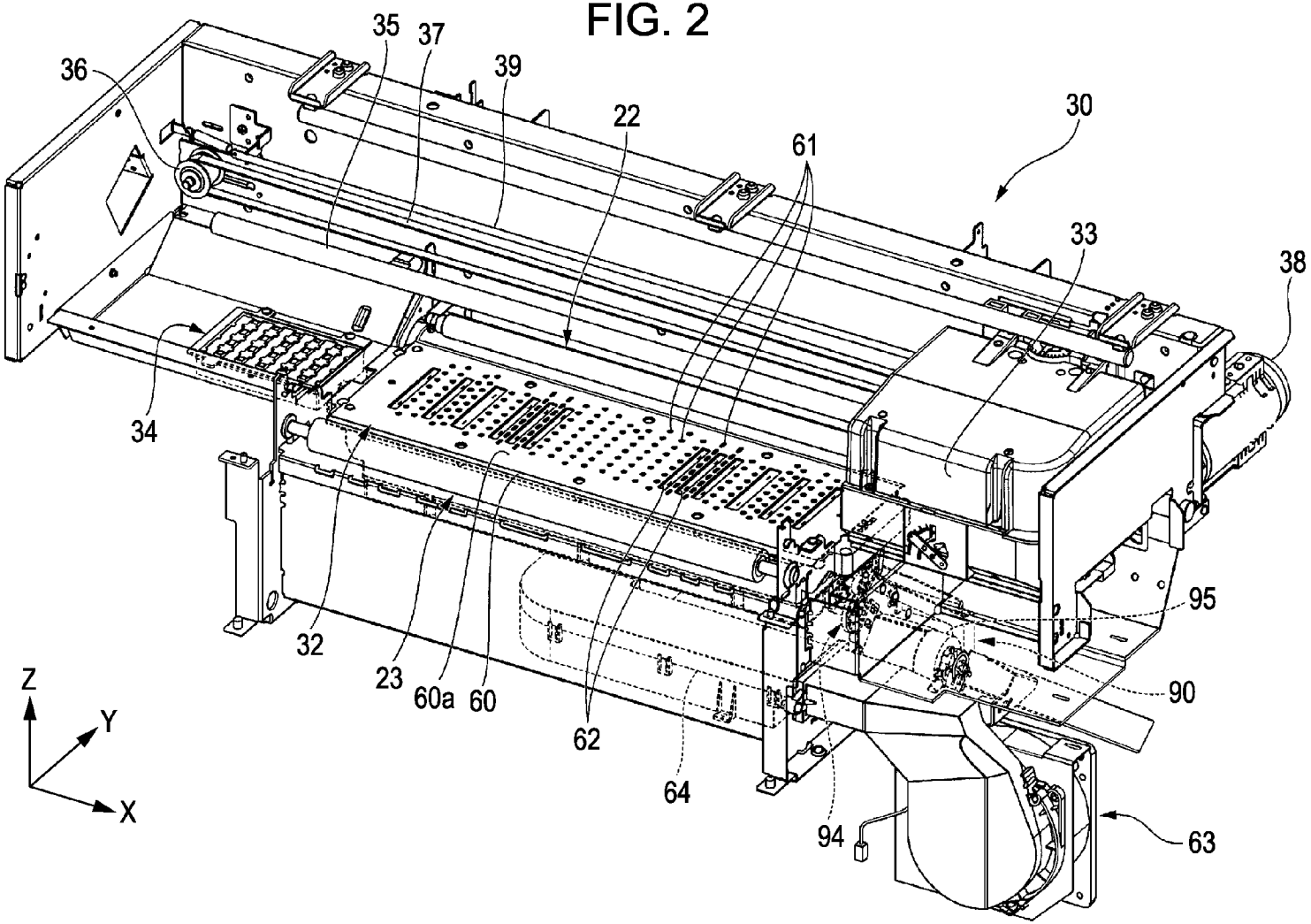
FIG. 2 is a perspective view illustrating a recording portion according to the embodiment of the invention.
Figure 3:
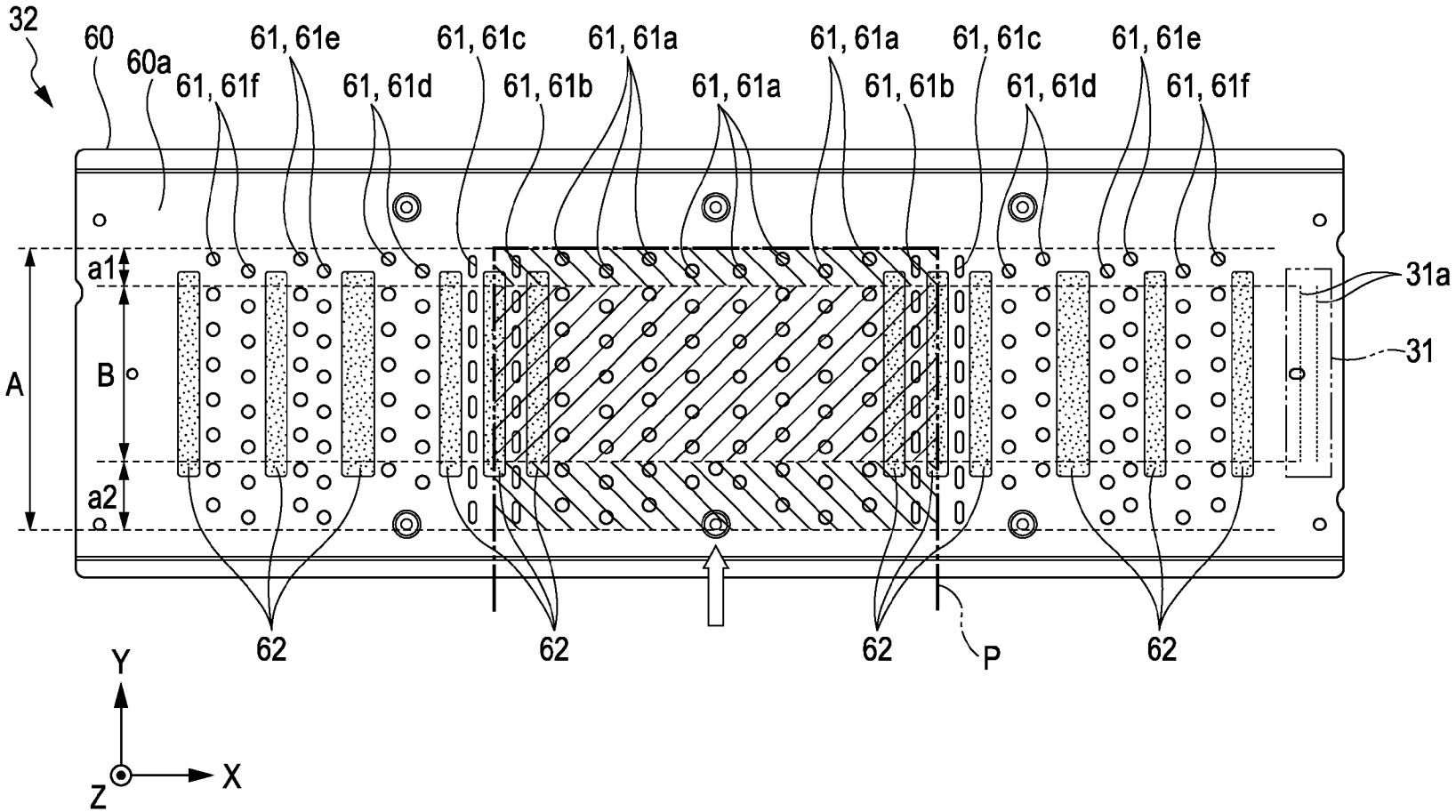
FIG. 3 is a plan view illustrating a platen on a supporting table according to the embodiment of the invention.

FIG. 2 is a perspective view illustrating the recording portion 30 according to the embodiment of the invention. FIG. 3 is a plan view illustrating a platen 60 on the supporting table 32 according to the embodiment of the invention.

A reference numeral 33 in FIG. 2 indicates a carriage on which the recording head 31 is mounted. The recording head 31 according to the embodiment is a so-called serial type ink jet head mounted on the carriage 33 which moves in the width direction (X-axis direction) of the paper P to be transported. It is to be noted that a reference numeral 34 in FIG. 2 indicates a flushing box which performs maintenance of the recording head 31 with flushing (preliminary dishcharge).

The carriage 33 is movably supported in the width direction by the guide rod 35. The carriage 33 is configured to move along the guide rod 35 by driving a belt 37 bridged on a pulley 36. The belt 37 is driven by a carriage motor 38. Further, a linear encoder 39 is provided on the recording portion 30 along a movement path of the carriage 33. The linear encoder 39 detects a position of the carriage 33 in the width direction. The detected signal is transmitted to a control device CONT as positional information. The control device CONT recognizes a scanning position of the recording head 31 based on the positional information from the linear encoder 39 so as to control a printing operation and the like by the recording head 31.

The supporting table 32 includes a platen (supporting member) 60 having a supporting face 60*a* which supports the paper P. As illustrated in FIG. 2 and FIG. 3, a plurality of suction holes 61 are formed on the supporting face 60*a* of the platen 60 in order to keep planarity of the paper P. Further, a plurality of ink reception portions (fluid reception portions) 62 which are opened on the supporting face 60*a* and receive ink are provided on the platen 60 in order to perform a so-called borderless printing. Each ink reception portion 62 includes an ink absorbent which absorbs ink, such as a sponge and a nonwoven fabric, for example. As a paper feeding form of the paper P in the embodiment, a so-called center feeding is employed and the ink reception portions 62 are arranged so as to be symmetry with respect to a center position of the platen 60. The ink reception portions 62 are provided at positions corresponding to paper widths in accordance with standards (A4, B4, A3, B3, and the like) of the paper P, respectively.

A suction region A on which the paper P is sucked with the plurality of suction holes 61 is extended in the width direction (X-axis direction). Suction through the suction holes 61 is performed by a fan 63 as illustrated in FIG. 2. The fan 63 and a bottom of the supporting table 32 are connected to each other through a duct 64. The recording portion 30 in the embodiment has a suction stopping device 90. The suction stopping device 90 stops suction with the suction holes 61 on the suction region A which is out of the paper P in the width direction in order to suppress curved flying of ink during printing.

Next, a configuration of the supporting table 32 including the suction stopping device 90 according to the embodiment is described in detail.

Figure 4:
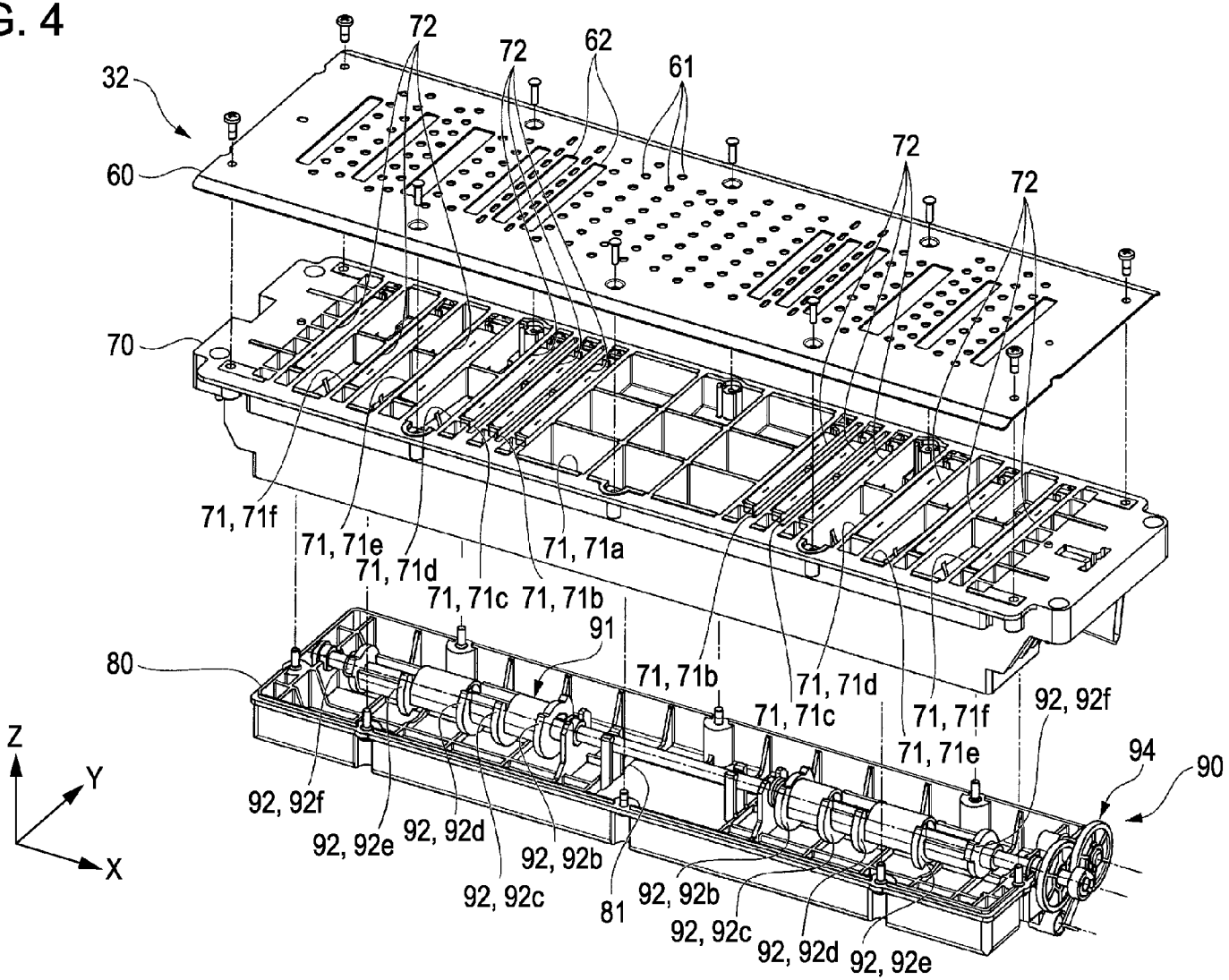
FIG. 4 is an exploded perspective view illustrating the supporting table according to the embodiment of the invention.
Figure 5:
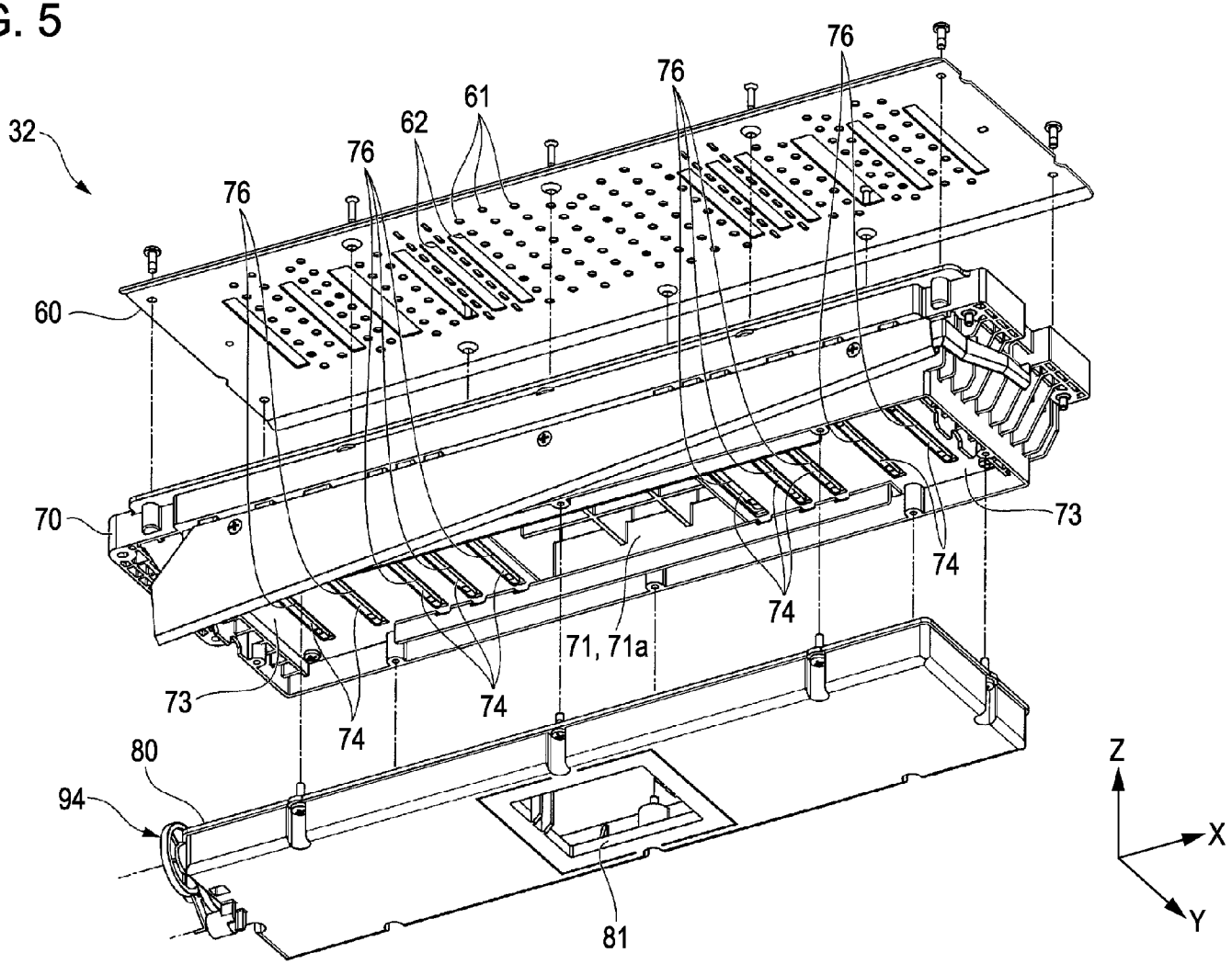
FIG. 5 is another exploded perspective view illustrating the supporting table according to the embodiment of the invention.
Figure 6:
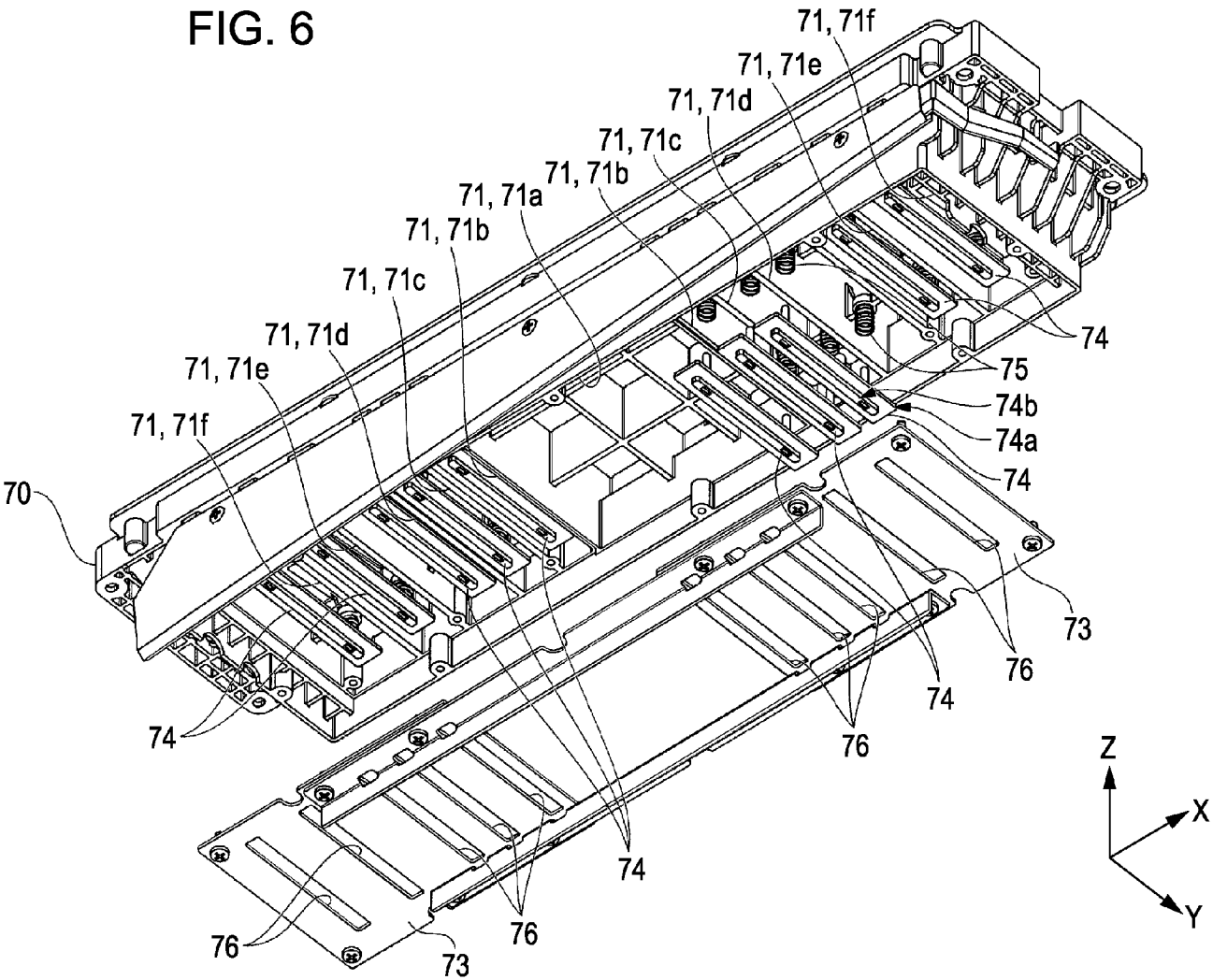
FIG. 6 is an exploded perspective view illustrating a supporting table main body according to the embodiment of the invention.
Figure 7A:
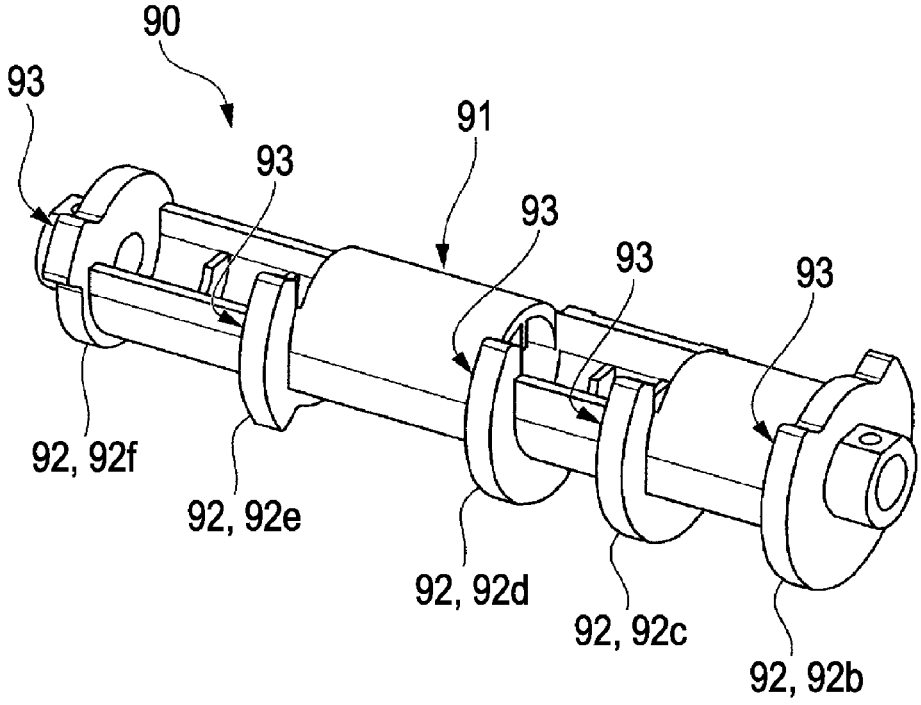
FIGS. 7A and 7B are perspective views illustrating a cam mechanism of a suction stopping device according to the embodiment of the invention.
Figure 7B:
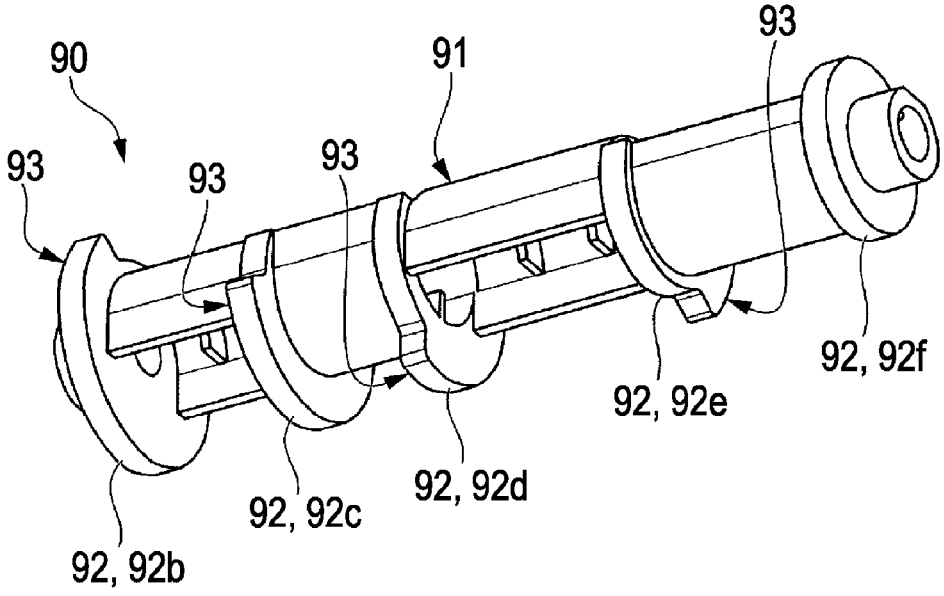

FIG. 4 is an exploded perspective view illustrating the supporting table 32 according to the embodiment of the invention. FIG. 5 is an exploded perspective view illustrating the supporting table 32 according to the embodiment of the invention. FIG. 6 is an exploded perspective view illustrating a supporting table main body 70 according to the embodiment of the invention. FIGS. 7A and 7B are perspective views illustrating a cam mechanism 91 of the suction stopping device 90 according to the embodiment of the invention.

As illustrated in FIG. 4, the supporting table 32 is configured by combining the platen 60, the supporting table main body 70, and a bottom frame 80. Air chambers 71 communicating with the suction holes 61 and ink reception chambers 72 communicating with the ink reception portions 62 are formed on the supporting table main body 70. The air chambers 71 are divided into a plurality of chambers in accordance with positions in the width direction. To be more specific, the air chambers 71 are divided into regions each of which is sandwiched by the ink reception chambers 72. It is to be noted that the air chamber 71 at the center is referred to as an air chamber 71*a*. The air chambers 71 which are adjacent to the air chamber 71*a* at the outer sides thereof are referred to as air chambers 71*b*. The air chambers 71 which are adjacent to the air chambers 71*b* at the outer sides thereof are referred to as air chambers 71*c*. The air chambers 71 which are adjacent to the air chambers 71*c* at the outer sides thereof are referred to as air chambers 71*d*. The air chambers 71 which are adjacent to the air chambers 71*d* at the outer sides thereof are referred to as air chambers 71*e*. Further, the air chambers 71 which are adjacent to the air chamber 71*e* at the outer sides thereof are referred to as air chambers 71*f*.

As illustrated in FIG. 5, bottoms of the air chambers 71 other than the air chamber 71*a* are closed by a frame 73 and valve bodies 74. That is to say, since the air chamber 71*a* is provided on a region corresponding to a minimum paper width of the paper P, the air chamber 71*a* is always opened. The suction holes 61 communicating with the air chamber 71*a* perform suction regardless of paper width of the paper P.

As illustrated in FIG. 6, the valve bodies 74 are provided on the air chambers 71 other than the air chamber 71*a*. The valve bodies 74 are biased toward the lower side with biasing members 75. Each valve body 74 has a rectangular-shaped base portion 74*a* extending in the transportation direction and a projection 74*b* projecting to the lower side from the base portion 74*a*. Each projection 74*b* has such size that the projection 74*b* can be inserted into an opening 76 formed on the frame 73.

Returning to FIG. 4, the bottom frame 80 is connected to a bottom of the supporting table main body 70 and functions as a chamber. An opening 81 to which the duct (see, FIG. 2) is connected is provided at the center of the bottom frame 80. A cam mechanism 91 which selectively lifts the valve bodies 74 is provided on the bottom frame 80. The cam mechanism 91 is rotatably supported about a shaft extending in the width direction. Further, the cam mechanism 91 includes cams 92 having shapes corresponding to the valve bodies 74 at positions corresponding to the valve bodies 74, respectively. To be more specific, the cam mechanism 91 has cams 92*b* corresponding to the valve bodies 74 of the air chambers 71*b*, cams 92*c* corresponding to the valve bodies 74 of the air chambers 71*c*, cams 92*d* corresponding to the valve bodies 74 of the air chambers 71*d*, cams 92*e* corresponding to the valve bodies 74 of the air chambers 71*e*, and cams 92*f* corresponding to the valve bodies 74 of the air chambers 71*f*.

As illustrated in FIGS. 7A and 7B, the shapes of the cams 92 are different from each other depending on positions in the width direction. Each cam 92 has a convex portion 93 having such diameter that the convex portion 93 can abut against the projection 74*b* of each valve body 74. Occupying ratios of the convex portions 93 of the cams 92 in a circumferential direction are different among the cams 92*b* to 92*f*. Ratio of the convex portion 93 on the cam 92*b* is the largest and is decreased in the order from the cams 92*c* to 92*f*.

To be more specific, if the cam mechanism 91 is rotated about a shaft, a state can be switched among a state where all of the cams 92*b* to 92*f* do not abut against the valve bodies 74, a state where only the cams 92*b* lift the valve bodies 74 to open the air chambers 71*b*, a state where the cams 92*b*, 92*c* lift the valve bodies 74 to open the air chambers 71*b*, 72*c*, a state where cams 92*b* to 92*d* lift the valve bodies 74 to open the air chambers 71*b* to 71*d*, a state where the cams 92*b* to 92*e* lift the valve bodies 74 to open the air chambers 71*b* to 71*e*, and a state where all of the cam 92*b* to 92*f* lift the valve bodies 74 to open all of the air chambers 71*b* to 71*f*.

The cam mechanism 91 having the above configuration is rotationally driven by a motor 95 (see, FIG. 2) connected to the cam mechanism 91 through a gear mechanism 94. The control device CONT drives the motor 95 based on paper width information of a set paper P so as to control a rotational angle of the cam mechanism 91. To be more specific, when the paper P having paper width as illustrated in FIG. 3 is set, the cam mechanism 91 is driven so as to be made into a state where only the cams 92*b* lift the valve bodies 74 to open the air chambers 71*b*. With this, suction by the suction holes 61*c* to 61*f* out of the paper P on the suction region A in the width direction can be stopped. It is to be noted that the suction holes 61*a* as illustrated in FIG. 3 communicate with the air chamber 71*a*, the suction holes 61*b* communicate with the air chambers 71*b*, the suction holes 61*c* communicate with the air chambers 71*c*, the suction holes 61*d* communicate with the air chambers 71*d*, the suction holes 61*e* communicate with the air chambers 71*e*, and the suction holes 61*f* communicate with the air chambers 71*f*.

As illustrated in FIG. 3, the plurality of suction holes 61 form a plurality of rows along the transportation direction (Y-axis direction) with spaces therebetween in the width direction (X-axis direction). Further, the plurality of suction holes 61 with the same shape are arranged at a constant pitch on each row along the transportation direction. The plurality of rows include first rows having the suction holes 61 with a first shape (circular hole shape) and second rows having the suction holes 61 with a second shape (oblong hole shape). The first rows include rows of the suction holes 61*a*, 61*d* to 61*f*. The second rows include rows of the suction holes 61*b*, 61*c*. The ink reception portions 62 are provided at both sides of the second rows in the width direction. The suction holes 61*b*, 61*c* on the second rows have oblong hole shapes extending in the transportation direction. Therefore, the suction holes 61*b*, 61*c* on the second rows are arranged on narrow regions on which sufficient widths cannot be obtained because the ink reception portions 62 are provided so that the paper P can be sucked.

The suction region A on which the paper P is sucked with the plurality of suction holes 61 includes a printing region B printed by the recording head 31 in the transportation direction. The suction region A extends to the upstream side and the downstream side with respect to the printing region B in the transportation direction. Further, a length a1 of the suction region A at the downstream side is smaller than a length a2 of the suction region A at upstream side in the transportation direction.

It is to be noted that the length of the suction region A in the transportation direction indicates a length from the suction holes 61 provided at upstream-most positions in the transportation direction (Y-axis direction) to the suction holes 61 provided at downstream-most positions in the transportation direction on the supporting face 60. Further, the length of the printing region B in the transportation direction indicates a length from upstream-most ends (upper ends) of the nozzle rows 31*a* of the recording head 31 through which ink is ejected in the transportation direction (Y-axis direction) to downstream-most ends (lower ends) of the nozzle rows 31*a* in the transportation direction.

Figure 8:
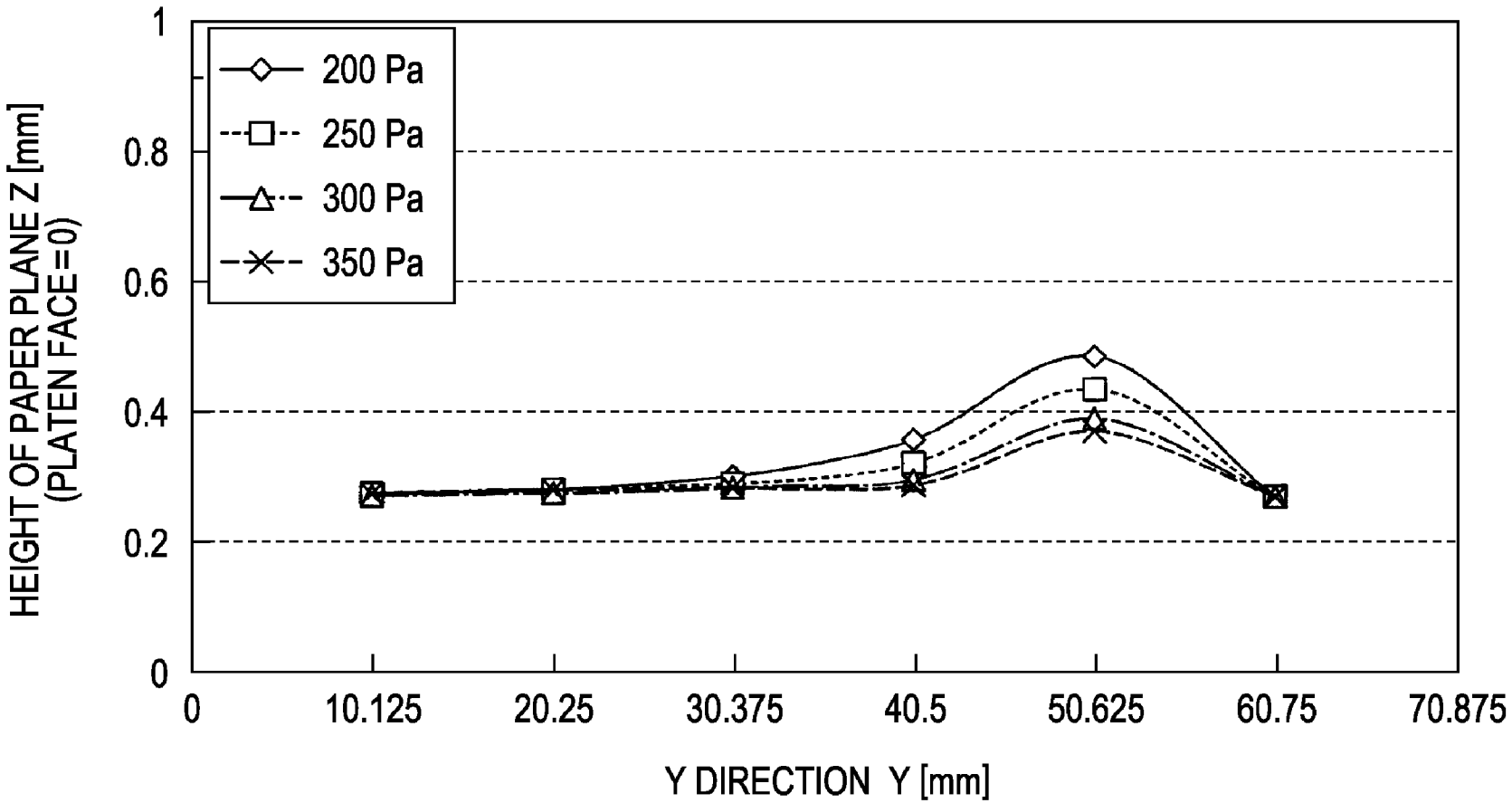
FIG. 8 is a graph illustrating a floating characteristic of a front end of a paper with respect to a supporting face according to the embodiment of the invention.

FIG. 8 is a graph illustrating a floating characteristic with respect to the supporting face 60*a* at a front end of the paper P according to the embodiment of the invention.

Since the paper P is unrolled and extended from the roll paper RP and fed, influence of curls is exhibited largely on a front end thereof. Further, if a suction force is increased, although floating of the front end of the paper P is reduced, it is difficult to completely pressing the paper P against the supporting face 60*a*. Accordingly, in the embodiment, the suction region A is made to extend to the downstream side with respect to the printing region B in the transportation direction so that a floating portion of the front end of the paper P is made to be out of the printing region B. Note that since the front end of the paper P out of the printing region B corresponds to a portion to be cut off as the cut piece Pk by the above-described cutting portion 40 as an unnecessary region. Therefore, the length a1 of the suction region A at the downstream side is set to be a minimum value based on the floating characteristic of the front end of the paper P as illustrated in FIG. 8. Accordingly, the length a1 of the suction region A at the downstream side is smaller than the length a2 of the suction region A at the upstream side in the transportation direction.

Subsequently, a printing operation on the recording portion 30 of the printer 11, which has the above configuration, is described.

At first, suction with the suction holes 61 which are out of the paper P on the suction region A in the width direction is stopped based on a paper width of the set paper P. To be more specific, the control device CONT drives the suction stopping device 90 so that such suction is stopped. When the paper P having the paper width as illustrated in FIG. 3 is set, the control device CONT drives the motor 95 based on the paper width information of the set paper P to control a rotational angle of the cam mechanism 91. With this, the state where only the cams 92*b* lift the valve bodies 74 to open the air chambers 71*b* is realized. Then, suction with the suction holes 61*a* communicating with the air chamber 71*a* which is always opened and the suction holes 61*b* communicating with the air chambers 71*b* which have been opened is started by driving the fan 63. On the other hand, the air chambers 71*c* to 71*f* are in a state of being closed by the valve bodies 74. Therefore, suction with the suction holes 61*c* to 61*f* which are out of the paper P on the suction region A in the width direction can be stopped.

Next, the paper P is transported in the Y-axis direction along the supporting face 60*a* of the platen 60 by the transportation portion 20. If the front end of the paper P enters the suction region A, a suction force by the suction holes 61*a*, 61*b* acts on the paper P. The suction holes 61*a*, 61*b* having the same shape are formed at a constant pitch on each row along the transportation direction on the suction region A. Therefore, the acting suction force as the paper P is transported can be made constant and variation thereof can be suppressed. Therefore, a transportation accuracy can be enhanced.

Further, the suction holes 61*b* sandwiched between the ink reception portions 62 have oblong hole shapes extending in the transportation direction. This enables the paper P to be sucked even on the narrow regions on which a sufficient width cannot be obtained.

As illustrated in FIG. 3, when the front end of the paper P in the transportation direction reaches to a position at which the front end of the paper P covers the suction holes 61 formed at the downstream-most positions in the transportation direction on the supporting face 60*a* beyond the printing region B, the control device CONT makes the recording head 31 execute printing. In the embodiment, since the suction region A extends to the downstream side with respect to the printing region B in the transportation direction, the floating portion of the front end of the paper P can be made to be out of the printing region B. Further, at this time, all of the suction holes 61*a*, 61*b* are closed by the paper P. Therefore, unnecessary air flow is not formed around the paper P. Accordingly, the recording head 31 can perform printing on the paper P having been ensured planarity without causing curved flying of ink. Therefore, an image and the like having high quality can be formed on the surface of the paper P.

Therefore, according to the above embodiment, the printer 11 including the platen 60 on which the plurality of suction holes 61 for sucking the paper P are formed on the supporting face 60*a* for supporting the paper P, the transportation portion 20 which transports the paper P along the supporting face 60*a*, the recording head 31 which ejects ink on the paper P supported by the supporting face 60*a* so as to perform printing, and the control device CONT which makes the recording head 31 execute printing when a front end of the paper P in the transportation direction reaches to a position at which the paper P covers the suction holes 61 formed at the downstream-most positions in the transportation direction on the supporting face 60*a* is employed. With this, the recording head 31 can be made to execute printing in a state where all of the suction holes 61 are closed and unnecessary air flow is not generated around the paper P.

Accordingly, in the embodiment, deterioration in printing quality due to curved flying of ink can be suppressed while ensuring planarity of the paper P.

As described above, a preferred embodiment of the invention has been described with reference to the drawings. However, the invention is not limited to the above embodiment. Shapes, combinations, and the like of the constituent members as illustrated in the above embodiment are merely examples and various changes can be made based on design requests and the like in a range without departing from the scope of the invention.

For example, if the printer 11 is an exclusive machine which prints the paper P having a constant paper width, a width of the suction region A may be set in accordance with the paper width. That is to say, even if the printer 11 does not include the suction stopping device 90, effects which are the same as those obtained in the above embodiment can be obtained if the control device CONT makes the recording head 31 execute printing when the front end of the paper P in the transportation direction reaches to a position at which the paper P covers the suction holes 61 formed at the downstream-most positions in the transportation direction on the supporting face 60*a*.

Further, in the above embodiment, a case where the recording apparatus is the printer 11 has been described as an example. However, the recording apparatus is not limited to the printer and may be apparatuses such as a copying machine and a facsimile.

Further, in the above embodiment, the ink jet printer 11 which ejects ink has been employed as an example of recording apparatuses. However, a recording apparatus which ejects and discharges liquid other than ink may be employed. The invention can be applied to various types of recording apparatuses including a recording head or the like which discharges a trace amount of liquid droplets. Note that the terminology "liquid droplets" represents a state of liquid which is discharged from the above recording apparatus. For example, a granule form, a teardrop form, and a form that pulls tails in a string-like form therebehind are included as the liquid droplets. The terminology "liquid" here represents materials which can be ejected by the recording apparatus. For example, any materials are included as long as the materials are in a liquid phase. For example, materials in a liquid state having high viscosity or low viscosity or a fluid state such as a sol, gel water, other inorganic solvents, an organic solvent, a solution, a liquid resin or a liquid metal (molten metal) can be included as the fluid. Further, the fluid is not limited to liquid as one state of a material but includes a solution, a dispersion or a mixture of particles of a functional material made of a solid material such as pigment, or metal particles. A typical example of the liquid is ink as described in the above embodiment. The terminology "ink" here includes various liquid compositions such as common aqueous ink and oil-base ink, gel ink and hot melt ink. A specific example of the recording apparatus is not limited to the apparatus which includes a roll paper obtained by winding a paper in a roll form in a container (case 12) as described in the above embodiment. For example, any apparatus can be employed as the recording apparatus as long as the apparatus includes a long recording medium of such as a substrate or a metal plate having flexibility, a plastic sheet or a fabric, which are wound in a roll form, in a container. Further, the long recording medium included in the container may not be necessarily wound in the roll form. For example, the long recording medium may be stacked in the container in a zigzag form.

What is claimed is:

1. A recording apparatus comprising:

a supporting member on which a plurality of suction holes for sucking a recording medium are formed on a supporting face for supporting the recording medium;

a transportation device which transports the recording medium along the supporting face;

a recording head which ejects fluid on the recording medium supported by the supporting face so as to perform printing; and a control device which makes the recording head execute the printing when a front end of the recording medium in the transportation direction reaches to a position beyond a printing region printed by the recording head, and the recording medium covers the suction holes formed at downstream-most positions in the transportation direction on the supporting face.

2. The recording apparatus according to claim 1, wherein a suction region on which the recording medium is sucked with the plurality of suction holes includes the printing region and extends to the upstream side and the downstream side with respect to the printing region in the transportation direction, and a length of the suction region at the downstream side is smaller than a length of the suction region at the upstream side in the transportation direction.

3. The recording apparatus according to claim 1, wherein the plurality of suction holes form a plurality of rows along the transportation direction with spaces in a width direction of the recording medium, which is perpendicular to the transportation direction, and the plurality of suction holes having the same shape are arranged at a constant pitch on each row along the transportation direction.

4. The recording apparatus according to claim 3, wherein the plurality of rows include first rows having the suction holes with a first shape and second rows having the suction holes with a second shape which is different from the first shape.

5. The recording apparatus according to claim 4, wherein the second shape is an oblong hole shape extending in the transportation direction.

6. The recording apparatus according to claim 5, wherein a plurality of fluid reception portions which are opened on the supporting face and receive the fluid are provided on the supporting face, and the fluid reception portions are provided at both sides of the second rows in the width direction.

7. The recording apparatus according to claim 1, wherein a suction region on which the recording medium is sucked with the plurality of suction holes extends in a width direction of the recording medium, which is perpendicular to the transportation direction, and a suction stopping device which stops the suction with the suction holes which are out of the recording medium on the suction region in the width direction is provided.

8. The recording apparatus according to claim 1, wherein the recording medium is unrolled and extended from a roll body and is Transported.

* * * * *